US008316559B2

(12) United States Patent
Sussmann

(10) Patent No.: US 8,316,559 B2
(45) **Date of Patent: *Nov. 27, 2012**

(54) SHOE, IN PARTICULAR SPORTS SHOE

(75) Inventor: Reinhold Sussmann, Schweinfurt (DE)

(73) Assignee: Puma SE, Herzogenaurach (DE)

( * ) Notice: Subject to any disclaimer, the term of this patent is extended or adjusted under 35 U.S.C. 154(b) by 1145 days.

This patent is subject to a terminal disclaimer.

(21) Appl. No.: 11/814,398

(22) PCT Filed: Jan. 4, 2006

(86) PCT No.: PCT/EP2006/000024

§ 371 (c)(1),
(2), (4) Date: Jul. 20, 2007

(87) PCT Pub. No.: WO2006/077009

PCT Pub. Date: Jul. 27, 2006

(65) Prior Publication Data

US 2008/0120870 A1 May 29, 2008

(30) Foreign Application Priority Data

Jan. 22, 2005 (DE) ..... 20 2005 001 005 U

(51) Int. Cl.
*A43B 13/18* (2006.01)
*A43B 21/26* (2006.01)
*A43B 21/32* (2006.01)

(52) U.S. Cl. ..... 36/28; 36/35 R; 36/37

(58) Field of Classification Search ..... 36/27, 28, 36/29, 35 B, 35 R, 37

See application file for complete search history.

(56) References Cited

U.S. PATENT DOCUMENTS

| | | | | |
|---|---|---|---|---|
| 1,764,353 | A * | 6/1930 | Sansone | 36/35 B |
| 4,521,979 | A * | 6/1985 | Blaser | 36/29 |
| 5,233,767 | A * | 8/1993 | Kramer | 36/28 |
| 5,493,791 | A * | 2/1996 | Kramer | 36/28 |
| 5,595,003 | A * | 1/1997 | Snow | 36/28 |
| 5,768,802 | A | 6/1998 | Bramani | |
| 5,915,819 | A | 6/1999 | Gooding | |
| 6,082,024 | A * | 7/2000 | Del Biondi | 36/28 |
| 7,080,467 | B2 * | 7/2006 | Marvin et al. | 36/29 |
| 7,153,560 | B2 * | 12/2006 | Hofmann | 428/178 |

FOREIGN PATENT DOCUMENTS

| | | |
|---|---|---|
| WO | WO 9935928 A1 * | 7/1999 |
| WO | 03/092423 | 11/2003 |

* cited by examiner

*Primary Examiner* — Khoa Huynh
*Assistant Examiner* — Sharon M Prange
(74) *Attorney, Agent, or Firm* — Lucas & Mercanti, LLP

(57) ABSTRACT

The invention relates to a shoe comprising an upper part and a sole, a support and inner part of an intermediate sole and an outer sole. The intermediate sole contains a damping element which comprises a plurality of first elements which are arranged adjacent to each other and which are embodied as a hollow body defining a receiving area in which an associated second element having a smaller cross-section than the first element can at least partially penetrate. The elements are coaxial. At least one part of the second elements have a prism or cylindrical form and are embodied at least partially as a massive part. Both of the elements, which are associated with each other, are connected together by means of an elastic connection section which only extends between the first element and the second element and the first element, the connecting section and the second element are embodied as a single piece.

18 Claims, 5 Drawing Sheets

25 %

60 %

90 %

SHOE, IN PARTICULAR SPORTS SHOE

The invention relates to a shoe, in particular a sports shoe, with a shoe upper part and a sole, the sole having a support part or inner part, which is connected to the shoe upper part, a midsole, which is connected to the support part or inner part, and an outsole, which is connected to the midsole, the midsole including, at least over part of the impact area of the shoe on the ground, a damping element, or being formed as a damping element, which has a number of first elements, which are arranged next to one another, extend substantially over a given height in a direction of loading in the unloaded state of the damping element and, formed as hollow bodies, define a receiving space into which an associated second element, of smaller dimensions in cross section than the first element, can penetrate, at least partially, the second element extending substantially over a given height in the direction of loading in the unloaded state of the damping element and being arranged coaxially in relation to the first element.

A shoe of this type is known from WO 03/092423 A1. In order to influence the cushioning and damping characteristics of the shoe according to desired criteria, it is known to integrate damping elements in particular into the midsole, so that in this respect specific properties are imparted to the sole. WO 03/092423 A1 describes for this purpose a damping element of the type mentioned of a special construction, in particular for a sports shoe. The damping element has a large number of individual elements which are arranged next to one another and respectively form a cushioning and damping chamber in the manner of a piston-cylinder system. First and second elements that correspond in their form are connected to one another by means of a connecting portion, loading of the sole having the effect that the smaller element enters the larger one, which for this purpose forms a receiving space.

According to the stated solution, a damping element of this type is primarily intended for being integrated into a midsole, for which there are further examples in the prior art. For this purpose, reference is made to EP 0 387 505 A1, which discloses a honeycomb damping element which is inserted into a receiving space in the midsole of the shoe.

The choice of materials that are used for the damping element and the choice of the geometry (dimensions of the first and second elements, in particular their wall thickness) make it possible to determine the cushioning and damping characteristics of the damping element within certain limits. However, sometimes the possibilities in this respect are limited on account of the space available, so that the influencing of the characteristics of the damping element remains restricted.

The invention is based on the problem of providing a shoe, in particular a sports shoe, which can be influenced more in its cushioning and damping properties, and as a result these properties can be set according to given wishes. It is intended that this can be performed in a simple way and at low cost in terms of production.

The solution to this problem provided by the invention is characterized in that the second element of the damping element has the form of a prism or cylinder, the prism or the cylinder being formed at least partially as a solid part, the two mutually assigned elements being connected to each other by means of an elastic connecting portion, which extends merely between the first element and the second element, and the first element, the connecting portion and the second element being formed as one piece. This applies at least to some of the provided second elements of the damping element.

While in the prior art the individual portions of the damping element always consist of plastic of a substantially constant thickness, the invention therefore envisages providing parts in the damping element that are at least to some extent solidly formed.

It is provided with preference that between 20% and 100% of the volume of the prism or cylinder comprises the material of the second element. It is provided with particular preference that between 30% and 70% of the volume of the prism or cylinder comprises the material of the second element.

The solidly formed region of the second element is advantageously arranged at least in the end region of the second element that is remote from the first element.

Furthermore, particularly good influencing of the cushioning and damping properties of the damping element is possible if the solidly formed region of the second element has a concavely formed surface. This may be part of the surface of a sphere or part of the surface of an ellipsoid.

At least over part of the impact area of the shoe on the ground, the midsole may be formed exclusively as a damping element, i.e. the damping element constitutes the exclusive connection between the support part or inner part and the outsole. In this case, the outsole may be formed by a number of individual sole parts, each sole part being arranged at the end of the second element that is remote from the first element or at the end of the first element that is remote from the second element. Furthermore, it may be provided that the form of the individual parts of the outsole corresponds t that of the second element or that of the first element in a section perpendicular to the direction of loading.

In this case, it may be provided that, together with the connecting portion, a first element and a second element in each case form a gastight chamber.

The first element and the second element may have a mutually corresponding form in a section perpendicular to the direction of loading. According to one embodiment, the first element and the second element have a polygonal, in particular hexagonal, form in a section perpendicular to the direction of loading. As an alternative to this, it may also be provided that the first element and the second element have a circular form in a section perpendicular to the direction of loading.

The first elements may be connected to one another in their lateral region, or their lateral bounding walls may in each case be formed by a common portion.

With preference, the first and/or second elements have at least to some extent different heights in the unloaded state of the damping element. In the unloaded state of the damping element, the connecting portion may be of a planar or curved shape in a plane perpendicular to the direction of loading. The last-mentioned configuration is conducive to the "piston" entering the "cylinder" under loading.

Since the first element, the connecting portion and the second element are formed as one piece, it is advantageously provided that the first element, the connecting portion and the second element are produced by a common injection-moulding process.

The midsole, provided with the damping element or formed by it, can absorb energy in the direction of loading when the sole is subjected to loading and can release it again when the sole is relieved of loading.

In order that this can take place with a restoring effect being achieved when the pressure is relieved from the damping element, the lower axial end region of the first element and the upper axial end region of the second element are connected to each other by means of the connecting portion. In the same way as the first and second elements, the connecting portion is also a part that is made of an elastic plastics material, so that, when a loading force is exerted on the damping element, a deformation takes place in the direction of loading. The second element thereby enters the receiving space of the first element in the manner of a piston.

In order that the initial state is resumed after the pressure on the damping element is relieved, not only is the connecting portion of an elastic configuration but also the following measures may be taken:

The end of the first element that is remote from the second element may be connected to a sealing foil, in particular welded to it. Consequently, the first element, the second element, the connecting portion and the sealing foil form a space that is closed off in a gastight manner, which has optimum cushioning and damping properties.

Individual "piston-cylinder elements" are in this case arranged next to one another to form a damping element of a greater two-dimensional extent. While the first elements, acting as "cylinders", are connected to one another, the second elements, the "pistons", stand freely next to one another.

With preference, the elements consist of plastic, in particular of thermoplastic material. Preferred materials intended for this are especially polyethylene, polypropylene, polybutane, polyamide, polyurethane or a mixture of at least two of these plastics. The plastic may be translucent or transparent. The outsole may also consist of plastic, preferably of polyethylene, polypropylene, polybutane, polyamide, polyurethane or a mixture of at least two of these plastics, or of rubber, the material not being translucent or not being transparent.

The material of the first element, of the second element and of the connecting portion and/or the geometrical dimensions of these parts and/or the proportion by volume of the solidly formed part may be selected to define the cushioning and/or damping properties of the damping element. In particular, the resilient rigidity of the damping element that is obtained can be influenced by the choice of the proportion by volume of the solid part; a higher volume of the solid part results in a higher resilient rigidity.

In the unloaded state of the midsole, the first element is advantageously located with its axial extent substantially outside the axial extent of the second element. This is to be understood as meaning that the piston-like second element is arranged axially outside the cylinder-like first element in the unloaded state of the midsole. Only when there is loading of the damping element in the direction of loading does the "piston" then enter the "cylinder".

The proposed configuration achieves the effect that the cushioning properties can be significantly influenced by choosing the volume of the solidly formed part in the second element of the damping element. Consequently, desired cushioning characteristics can be imparted to a damping element of the generic type over wider ranges than is possible in the prior art.

Exemplary embodiments of the invention are represented in the drawing, in which:

FIG. 1 schematically shows a shoe, viewed from the side,

FIG. 4*a* to

Figure 3:
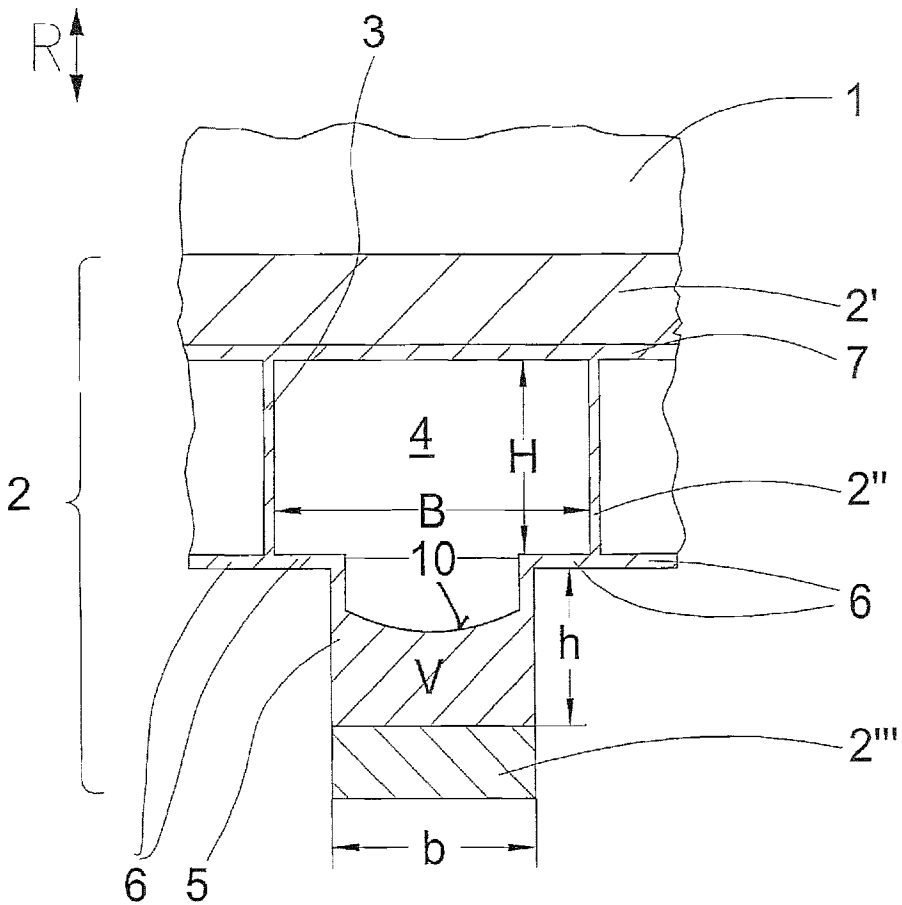
FIG. 3 shows the section A-B according to FIG. 2.
Figure 4A:
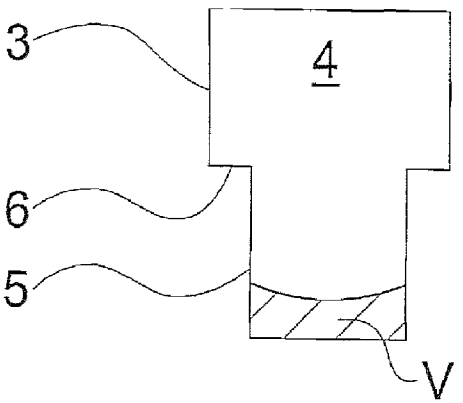
Figure 4B:
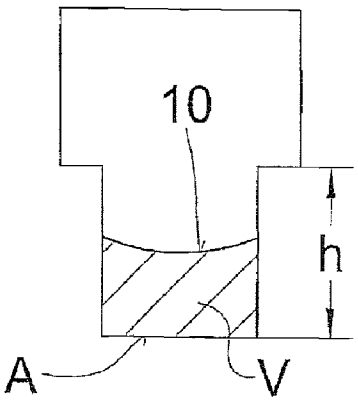
Figure 4C:
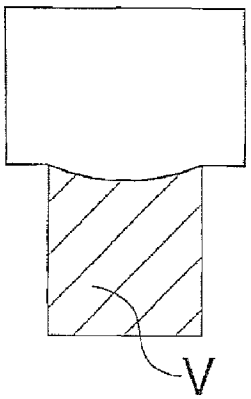
Figure 5B:
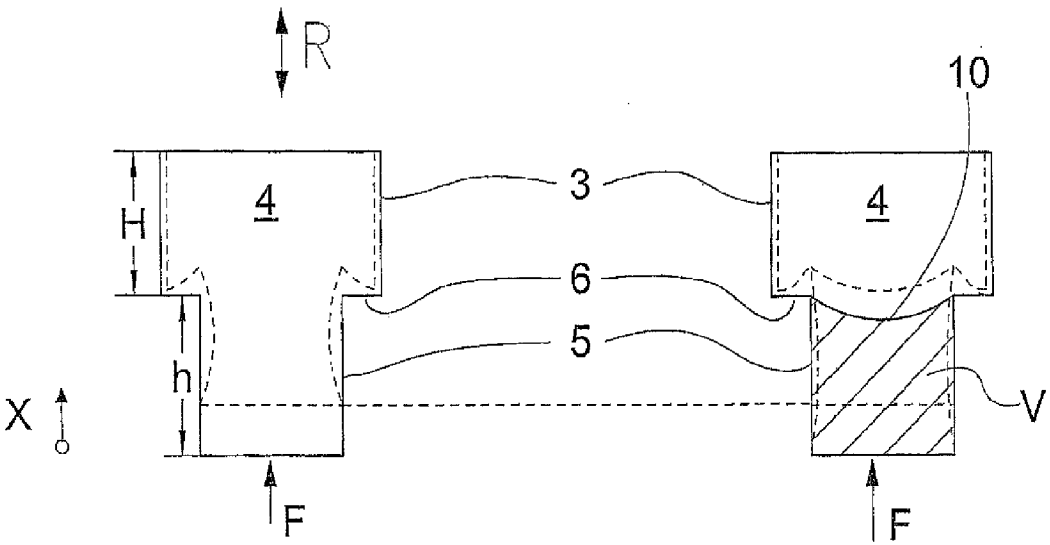
Figure 5B:
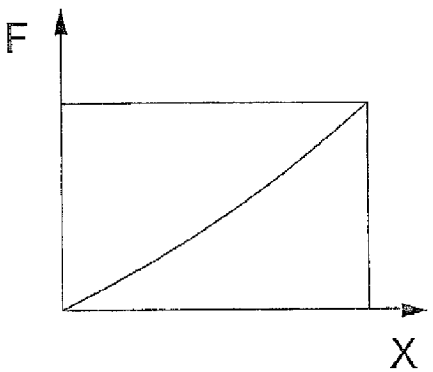
Figure 5A:
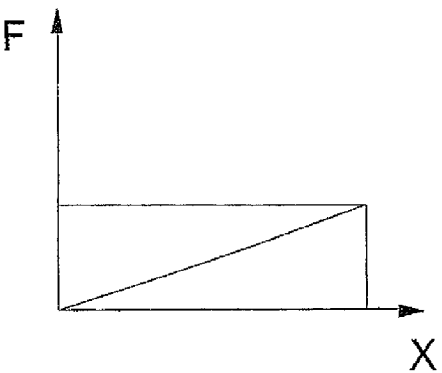
Fig. 5a PRIOR ART

FIG. 4*c* show three exemplary embodiments of the damping element in a representation analogous to FIG. 3, with solid portions of the second element of the damping element of different sizes and FIG. 5*a* and FIG. 5*b* respectively show the load-free form and the form obtained under loading for a known damping element and a damping element according to the invention, in each case with the resultant characteristic curves for resilience.

Figure 1:
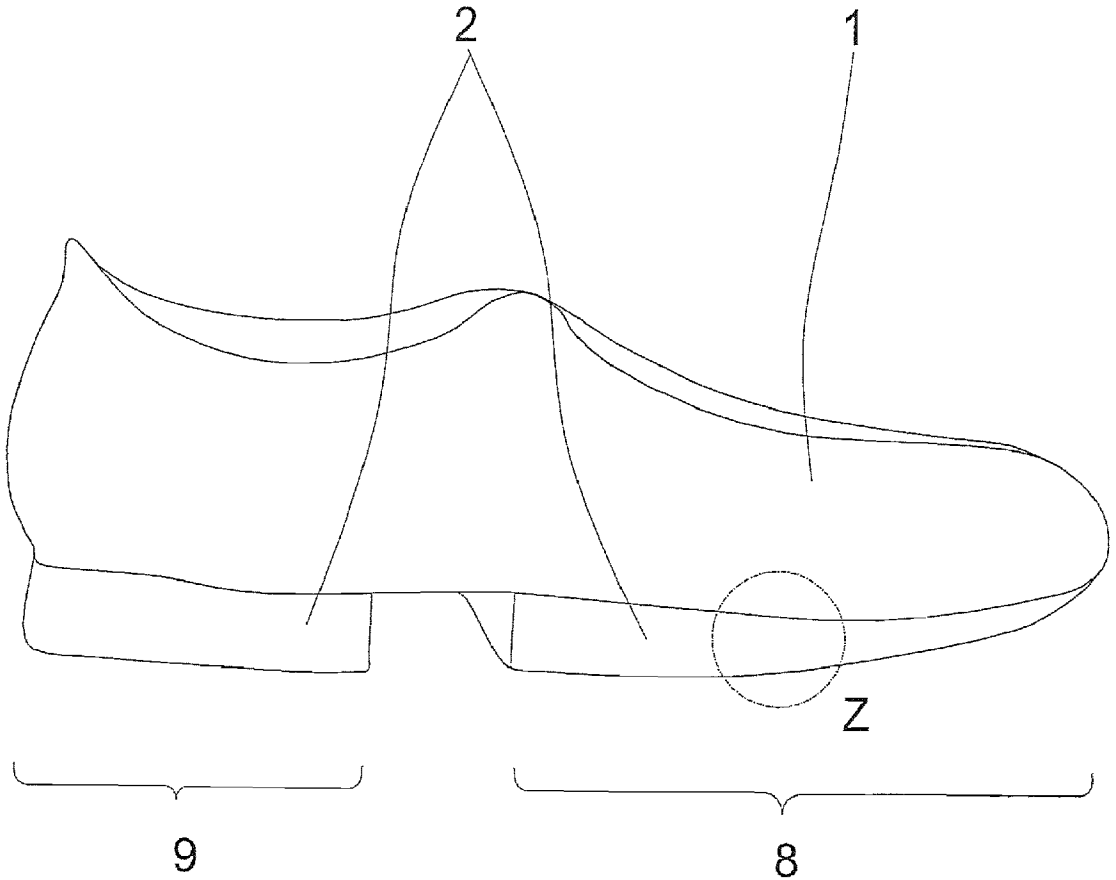

In FIG. 1, a shoe, to be specific a sports shoe, is represented only very schematically. The shoe has in a known way a shoe upper part 1, which is connected to a sole 2.

The sole 2 is formed in such a way that it extends in the front sole region 8 over a certain two-dimensional extent. In the rear sole region 9, it likewise extends over a defined two-dimensional extent.

Figure 2:
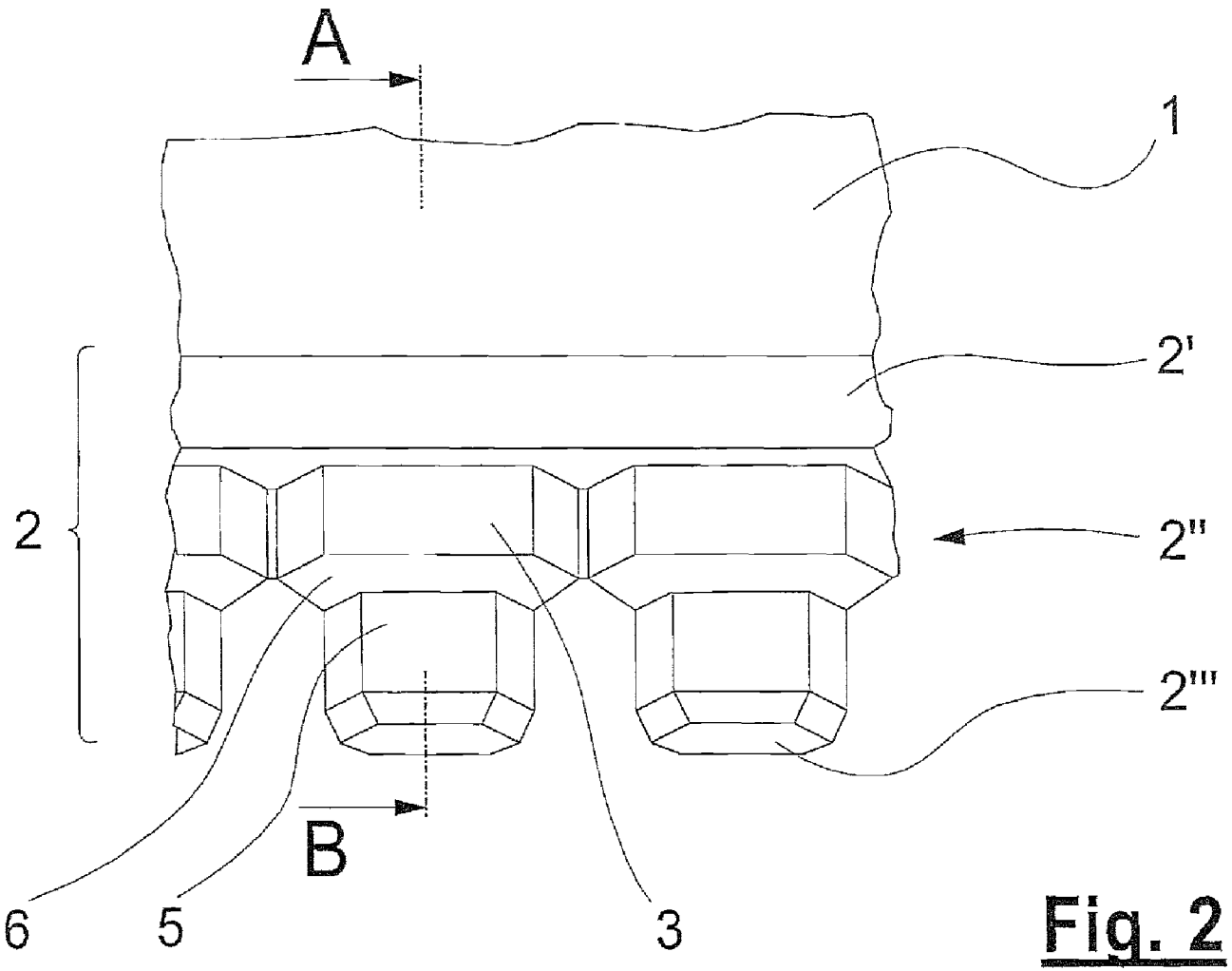
FIG. 2 shows the enlargement "Z" according to FIG. 1.

The construction of the sole 2 is illustrated in greater detail in FIG. 2. The sole 2 comprises three (sole) parts, to be specific a support part or inner part 2', a midsole 2" and an outsole 2'". The support part or inner part 2' may be an insole, a Strobel sole or actual material of the shoe upper, forming the connection between the shoe upper part 1 and the midsole 2". A particularly preferred embodiment provides that the support part or inner part 2' is produced as a plastics injection moulding (with preference of EVA) and is formed as a shell.

The support part or inner part 2' is connected to the shoe upper part 1. The connection may be produced, for example, by an injection-moulding process, in that the plastics material forming the support part or inner part 2' is injected onto the upper part 1, consisting for example of textile material. Adhesive bonding of the shoe upper part 1 and the support part or inner part 2' is also equally possible.

The midsole 2" comprises a large number of damping elements, which are constructed in the manner of a piston-cylinder system. Arranged at the end of the midsole 2" that is remote from the support part or inner part 2' is the outsole 2'", which comprises a number of sole segments 2'" corresponding to the number of damping elements.

It should be noted that the entire sole does not necessarily have to be constructed in the way explained. For example, only the front sole region 8 may be configured in the way described, while the rear foot region may be formed in a known way.

In the exemplary embodiments, the outsole 2'" is formed in a segmented manner, the damping element exclusively forming the midsole 2". However, it may also equally be provided that the outsole 2'" is attached as a large-area element to the axial end of the piston-cylinder systems. Likewise, the sketched damping element may be integrated into a classic midsole, as is the case with the prior art according to EP 0 387 505 A1, which was cited at the beginning.

The precise construction of the sole 2 for the embodiment with a segmented outsole 2'" is illustrated by FIGS. 2 and 3 together.

In the exemplary embodiment, the individual damping elements that form the midsole 2" are formed—when viewed in the direction of loading R of the sole 2—with a hexagonal basic form in the manner of a honeycomb pattern (see FIG. 2).

Each damping element has a first element 3, which extends over a defined height H and forms a receiving space 4. The end of the first element 3 that is remote from the support part or inner part 2' is connected by means of a web-shaped connecting portion 6 to a second element 5, which has a form corresponding to the form of the first element 3—when viewed in direction R—, i.e. the second elements 5 also have a hexagonal form in the exemplary embodiment. The second element 5 extends over a height h, which does not have to be equal to the height H.

As can be seen from FIG. 3, the dimensions—width B of the first element 3 and width b of the second element 5—are chosen such that the second element 5 can enter the receiving space 4, which is defined by the first element 3, when there is loading of the damping element in direction of loading R. The first element 3 and the second element 5 accordingly operate in the manner of a telescopic damper, the first element 3 acting as a "cylinder", which the second element 5 can enter in the manner of a "piston".

At the end of the second element 5 that is remote from the support part or inner part 2', an outsole segment 2''', which consists for example of abrasion-resistant plastics material, is attached, for example adhesively attached or else moulded on directly. When viewed in direction R, the outsole segment 2''' also has a form which corresponds to that of the second element 5, which however does not necessarily have to be the case.

If a force is exerted on the outsole segment 2''' in direction R, as takes place when the shoe makes impact with the ground, the connecting portion 6 deforms in particular, so that, as explained, the second element 5 enters the receiving space 4 of the first element 3 in the manner of a piston.

To have a positive influence on the resilient deflection characteristics, the space that is enclosed by the first element 3, the connecting portion 6 and the second element 5 may be formed in a gastight manner.

If appropriate, gas tightness with respect to the support part or inner part 2' may be established by a foil 7, which if need be is adhesively attached or welded onto the end region of the first element 3 that is towards the support part or inner part 2'.

Both the first element 3 and the second element 5 form a prism (in the case of a polygonally, for example hexagonally, formed element cross section) or a cylinder (in the case of a roundly formed element cross section), which extends over the respective heights H and h.

As FIG. 3 illustrates, it is provided as an essential feature of the invention that at least part of the resultant prism or cylinder volume (as a product of the cross-sectional area and the height h) of the second element 5 is solidly formed. In FIG. 3, a proportion accounted for by the solid volume V that is approximately 60% of the total prism or cylinder volume is represented (100% of the volume V is indicated in FIG. 3 by the dashed line). The solid (plastic) block with its volume V is placed in the end of the second element 5 that is remote from the first element 3. The surface 10 of the solidly formed material is provided in the present case with a concave form, which has effects on the deformation of the damping element.

Preferred values for the solid part of the prism or the cylinder are at volumes V of between 20% and 100% of the total prism or cylinder volume; particularly preferred values lie between 30% and 70%.

In FIGS. 4*a* to 4*c*, this is illustrated for three cases of examples. In FIG. 4*a*, the proportion of the volume V that is solid is about 25% of the total volume of the prism or the cylinder that is formed by the second element 5 (the total volume is obtained as a product of the base area A and the height h).

FIG. 4*b* shows a solid proportion V of a good half of the total volume of the prism or the cylinder, to be specific about 60%; in FIG. 4*c*, the solid proportion is about 90%.

In FIG. 5*a* and FIG. 5*b*, the comparison of the configuration according to the invention (in FIG. 5*b*) with that according to the prior art (in FIG. 5*a*) is illustrated. In both figures, the load-free form of the damping element represented can be seen in solid lines, while the form that is obtained when a force F is exerted in the direction of loading R is entered in dashed lines.

As can be seen in the top part of FIG. 5*a*, not only the connecting portion 6 but also the walls of the second element 5 are greatly deformed by the force F, while the walls of the first element 3 are scarcely deformed at all. As a result, the damping element is relatively soft, which can be seen from the shallow rise of the curve in the lower part of FIG. 5*a*, where the variation of the force (plotted on the x axis) can be seen against the displacement x (plotted on the y axis) in a Cartesian system of coordinates.

By contrast, in FIG. 5*b* the proportion of the volume V that is solid stiffens the second element 5, so that its walls can scarcely bend when it undergoes deformation. Accordingly, the connecting portion 6 must be deformed more if a given displacement is to be achieved. This results in the steeper shape of the curve in the lower part of FIG. 5*b*, i.e. a greater resilient stiffness (in both FIGS. 5*a* and 5*b*, the same displacements x in the deformed state are illustrated).

The volume V of the solid part of the second element 5 can be incorporated in a simple way in production terms when the said element is being injection-moulded, so that virtually no additional costs are incurred when the concept according to the invention is realized.

List Of Designations

1 shoe upper part
2 sole
2' support part or inner part
2'' midsole
2''' outsole
3 first element
4 receiving space
5 second element
6 connecting portion
7 sealing foil
8 front sole region
9 rear sole region
10 surface
R direction of loading
H height of the first element
h height of the second element
B dimension of the first element
b dimension of the second element
V volume
A base area
x displacement
F force

The invention claimed is:

1. Shoe comprising:

a shoe upper part and a sole, the sole having a support part which is connected to the shoe upper part, a midsole which is connected to the support part and an outsole, which is connected to the midsole, the midsole including, at least over part of the impact area of the shoe on the ground, a damping element which has a number of first elements, which are arranged next to one another, extend substantially over a given height (H) in a direction of loading (R) in the unloaded state of the damping element and each of the first elements is a hollow body that forms a receiving space into which an associated second element, of smaller dimensions in cross section than the first element, can penetrate, at least partially, the second element extending substantially over a given height (h) in the direction of loading (R) in the unloaded state of the damping element and being arranged coaxially in relation to the first element, wherein the first element and the second element have a mutually corresponding form in a section perpendicular to the direction of loading (R), wherein the first element and the second element have a polygonal or circular form in a section perpendicular to the direction of loading (R), wherein at least some of the second elements have the form of a prism or cylinder, the prism or the cylinder being formed at least partially as a solid part, and between 30% and 70% of the prism or cylinder volume comprises the material of the second element, the two mutually assigned elements being connected to each other by means of an elastic connecting portion, which extends merely between the first element and the second element, and the first element, the connecting portion and the second element being formed as one piece.

2. Shoe according to claim 1, wherein the solidly formed region of the second element is arranged at least in the end region of the second element that is remote from the first element.

3. Shoe according to claim 1, wherein the solidly formed region of the second element has a concavely formed surface.

4. Shoe according to claim 1, wherein at least over part of the impact area, of the shoe on the ground, the midsole is formed exclusively as a damping element.

5. Shoe according to claim 4, wherein the outsole is formed by a number of individual sole parts, each sole part being arranged at the end of the second element that is remote from the first element.

6. Shoe according to claim 5, wherein the form of the individual parts of the outsole corresponds to that of the second element in a section perpendicular to the direction of loading (R).

7. Shoe according to claim 1, wherein together with the connecting portion, a first element and a second element in each case form a gastight chamber.

8. Shoe according to claim 1, wherein the first elements are connected to one another in their lateral region, or their lateral bounding walls are in each case formed by a common portion.

9. Shoe according to claim 1, wherein the first and/or second elements have at least to some extent different heights (H, h) in the unloaded state of the damping element.

10. Shoe according to claim 1, wherein in the unloaded state of the damping element, the connecting portion is of a planar shape in a plane perpendicular to the direction of loading (R).

11. Shoe according to claim 1, wherein in the unloaded state of the damping element, the connecting portion is of a curved shape in a plane perpendicular to the direction of loading (R).

12. Shoe according to claim 1, wherein the first element, the connecting portion and the second element are produced by a common injection-moulding process.

13. Shoe according to claim 1, wherein the end of the first element, that is remote from the second element is connected to a sealing foil.

14. Shoe according to claim 1, wherein the elements consist of plastic, in particular of thermoplastic material.

15. Shoe according to claim 14, wherein polyethylene, polypropylene, polybutane, polyamide, polyurethane or a mixture of at least two of these plastics is provided as the plastic.

16. Shoe according to claim 14 wherein the plastic is translucent or transparent.

17. Shoe according to claim 1, wherein the outsole consists of plastic, preferably of polyethylene, polypropylene, polybutane, polyamide, polyurethane or a mixture of at least two of these plastics, or of rubber, the material not being translucent or not being transparent.

18. Shoe according to claim 1, wherein the material of the first element, of the second element and of the connecting portion and/or the geometrical dimensions of these parts and/or the proportion by volume of the solidly formed part are selected to define the cushioning and/or damping properties of the damping element.

* * * * *